United States Patent [19]

Parkinson

[11] Patent Number: 4,643,444

[45] Date of Patent: Feb. 17, 1987

[54] SKI STEERING APPARATUS

[76] Inventor: George L. Parkinson, 4401 Devonshire, Lansing, Mich. 48910

[21] Appl. No.: 755,163

[22] Filed: Jul. 15, 1985

[51] Int. Cl.[4] ..... A63C 5/06; A63C 11/00; A63B 69/18

[52] U.S. Cl. ..... 280/606; 280/818; 434/253

[58] Field of Search ..... 280/606, 818; 434/253

[56] References Cited

U.S. PATENT DOCUMENTS

| | | | |
|---|---|---|---|
| 2,367,271 | 1/1945 | Habostad . | |
| 2,490,183 | 12/1949 | Wheeler . | |
| 2,564,420 | 8/1951 | Brown . | |
| 2,609,210 | 9/1952 | Jennings . | |
| 2,894,760 | 7/1959 | Kolstad | 280/606 X |
| 3,088,748 | 6/1963 | Malmo . | |
| 3,269,742 | 8/1966 | Finyak et al. | 280/606 |
| 4,134,600 | 1/1979 | McDonald . | |
| 4,363,495 | 12/1982 | Henson . | |
| 4,453,742 | 6/1984 | Zepkowski . | |

*Primary Examiner*—Nancy Swisher
*Attorney, Agent, or Firm*—Ian C. McLeod

[57] ABSTRACT

A ski steering apparatus (10) including a handlebar (11), a column (13) and telescoping member (15), fork (18) and pivotable and rotatable connector (20, 40) to each of a pair of skis (100) is described. The apparatus allows the skier to steer the skis by rotating the handle about the longitudinal axis of the support means. The connector preferably also allows the apparatus (10) to be positioned in front of the tips of the skis so that a trainer in front of the skier can guide the skier down a hill.

14 Claims, 4 Drawing Figures

SKI STEERING APPARATUS

BACKGROUND OF THE INVENTION (1) Field of the Invention

The present invention relates to a snow ski steering apparatus which is particularly adapted for use by a handicapped skier in downhill skiing with or without a downhill positioned trainer controlling the apparatus. In particular the present invention relates to an apparatus which uses a handlebar attached to a fork having a universal joint or other flexible connection to the tips of each ski such that rotating or turning the handlebar allows steering of the skis.

(2) Prior Art

Downhill snow skiing requires considerable skill and balance. The two skis tend to separate because of the terrain and/or the inexperience of the skier. Ski poles aid the skier in maintaining balance; however, skiing is still a difficult sport to master.

Handicapped persons, such as those suffering from muscular disorders, would like to snow ski; however, their muscle coordination and strength may not be sufficient. The ski steering apparatus of the prior art are not particularly adapted for use by the handicapped.

U.S. Pat. No. 4,453,742 to Zepkowski describes parallel handles which can be pivoted towards and away from each other in order to control the spreading of the skis which are joined together adjacent at the tips. U.S. Pat. No. 4,363,495 to Henson describes a pair of handles adjacent the point of foot attachment to the skis which can be moved laterally to change the edging of the skis. U.S. Pat. No. 4,134,600 to McDonald et al describes a roller ski apparatus supporting a skier on pavement wherein two handles are used to aid in steering. The handles pivot along the longitudinal axis of the skis and thus provide limited steering control. U.S. Pat. No. 3,885,805 to Solymosi describes the use of ski poles attached adjacent the tips of unconnected skis permitting the skier to lean forward and backward by holding onto the poles. U.S. Pat. No. 3,088,748 to Malmo describes parallel poles held together by a handle and clip to skis which are not joined together. This invention mainly concerns itself with skis which may be used effectively in hard snow and in icy conditions. U.S. Pat. No. 2,609,210 to Jennings describes handles which allow lateral movement of the skis and steering by leaning sideways. U.S. Pat. No. 2,564,420 to Brown shows a steering handle which is rigidly connected to the tips of the skis, providing relative lateral angular displacement of the skis for steering. U.S. Pat. No. 2,490,183 to Wheeler describes the use of ski poles connected to skis which move forward and rearward of the skis in the plane of the longitudinal axis of the skis and permit limited lateral movement for steering. U.S. Pat. No. 2,367,271 to Habostad describes a sled where handles are used to aid in steering. This invention primarily relates to a sled which can be taken apart and used with skis and ski poles.

None of the prior art apparatus are adapted to easily simulate the edging and turning of skis which occurs in normal skiing. Thus in conventional downhill skiing the inside edges of the skis are involved in a turn and the skier shifts his weight to the downhill ski. Further, the skis must be able to form the snow plow position for turning. Finally and most importantly the steering apparatus must allow a trainer to hold onto the apparatus downhill of the skier and steer the skier down the hill for training or for handicapped persons.

OBJECTS

It is therefore an object to provide a ski steering apparatus which allows complete skier control of the skis. Further it is an object of the present invention to provide a device which can be controlled by a trainer downhill of the skier in a manner which simulates control by the skier without the apparatus. These and other objects will become increasingly apparent by reference to the following description and the drawings.

IN THE DRAWINGS

GENERAL DESCRIPTION

Figure 1:
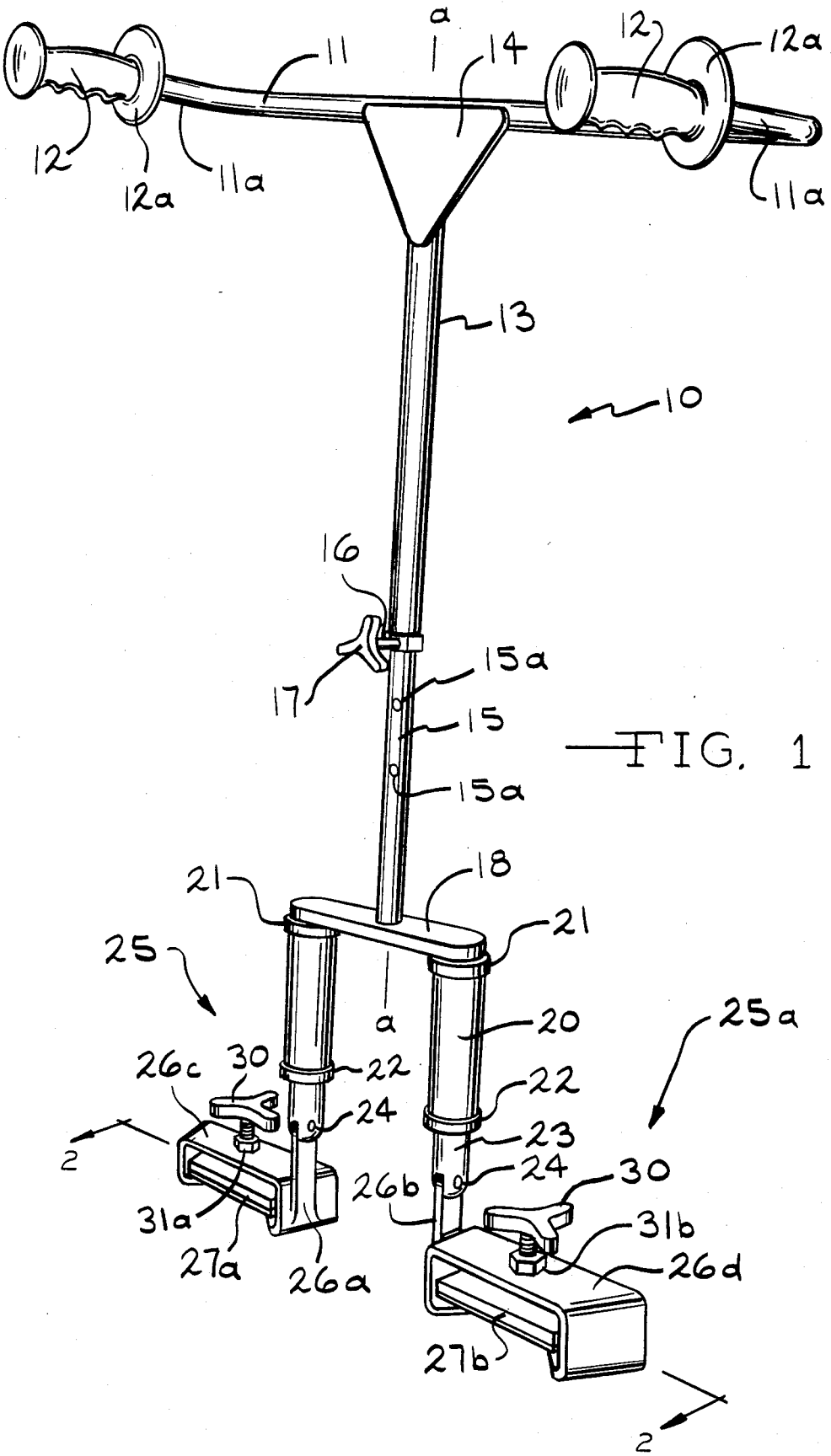
FIG. 1 is a front perspective view of the ski steering apparatus of the present invention, particularly illustrating a handle bar joined by a support means to a fork with flexible connectors attached to clamps for holding the tips of the skis.

The present invention relates to a ski steering apparatus for a pair of downhill snow skis with curved tips at a downhill end, each ski having a top, opposed side edges and a bottom which comprises: a handle bar with handles at opposite ends of the bar for each hand of a skier; support means defining a longitudinal axis of the apparatus mounted on the handlebar between the grips; a fork mounted on the support means; a pair of spaced apart pivotable and rotatable joint connector means joined to the fork; and clamp means for attachment to each ski adjacent the tips of the skis joined to the joint connector means, wherein the skis are steered into a turn by the skier by rotating the apparatus on the longitudinal axis of the support means with the handlebar in a direction opposite to the direction of the turn.

The present invention particularly relates to a ski steering apparatus for a pair of downhill snow skis with curved tips at a downhill end, each ski having a top, opposed side edges and a bottom which comprises: a handle bar with handles at opposite ends of the bar for each hand of a skier; support means defining a longitudinal axis of the apparatus mounted on the handle bar between the grips; a fork mounted on the support means having a pair of spaced apart tines; flexible connector means each having a top portion and a bottom portion joined to each of the tines at the top portions; and clamp means for attachment to each ski adjacent the tips of the skis joined to the bottom portion of the flexible connector means, wherein the skis are steered into a turn by the skier by rotating the apparatus on the longitudinal axis of the support means with the handlebar in a direction opposite to the direction of the turn.

The present invention also relates to the method of training a snow skier which comprises: providing a ski steering apparatus for a pair of downhill snow skis with curved tips at a downhill end, each ski having a top, opposed side edges and a bottom, the apparatus having a handle bar with handles at opposite ends of the bar for each hand of a skier, support means defining a longitudinal axis of the apparatus mounted on the handle bar between the grips, a fork mounted on the support means, a pair of spaced apart pivotable and rotatable joint connector means joined to the fork, and clamp means for attachment to each ski adjacent the tips of the skis joined to the joint connector means; and providing a trainer facing the skier who grips the handles and steers the skier downhill wherein the skis on the skier are steered into a turn by the skier by rotating the apparatus on the longitudinal axis of the support means with the handlebar in a direction opposite to the direction of the turn.

The present invention further relates to the method of training a snow skier: providing a ski steering apparatus for a pair of downhill snow skis with curved tips at a downhill end, each ski having a top, opposed side edges and a bottom the apparatus having a handle bar with handles at opposite ends of the bar for each hand of a skier, support means defining a longitudinal axis of the apparatus mounted on the handle bar between the grips, a fork mounted on the support means; a pair of spaced apart pivotable and rotatable joint connector means joined to the fork, and clamp means for attachment to each ski adjacent the tips of the skis joined to the joint connector means; and steering the skis into a turn by rotating the handle bars on the longitudinal axis of the support means with the handlebar in a direction opposite to the direction of the turn.

The pivotable and rotatable joint connector means can be provided by a ball and socket bearing; however, this is not preferred, since it is prone to freezing. The connector means is rotatable around each tine of the fork and also pivotable on the tine. The flexible connector means described hereinafter is preferred for simplicity of manufacture and absence of problems with freezing.

SPECIFIC DESCRIPTION

Figure 2:
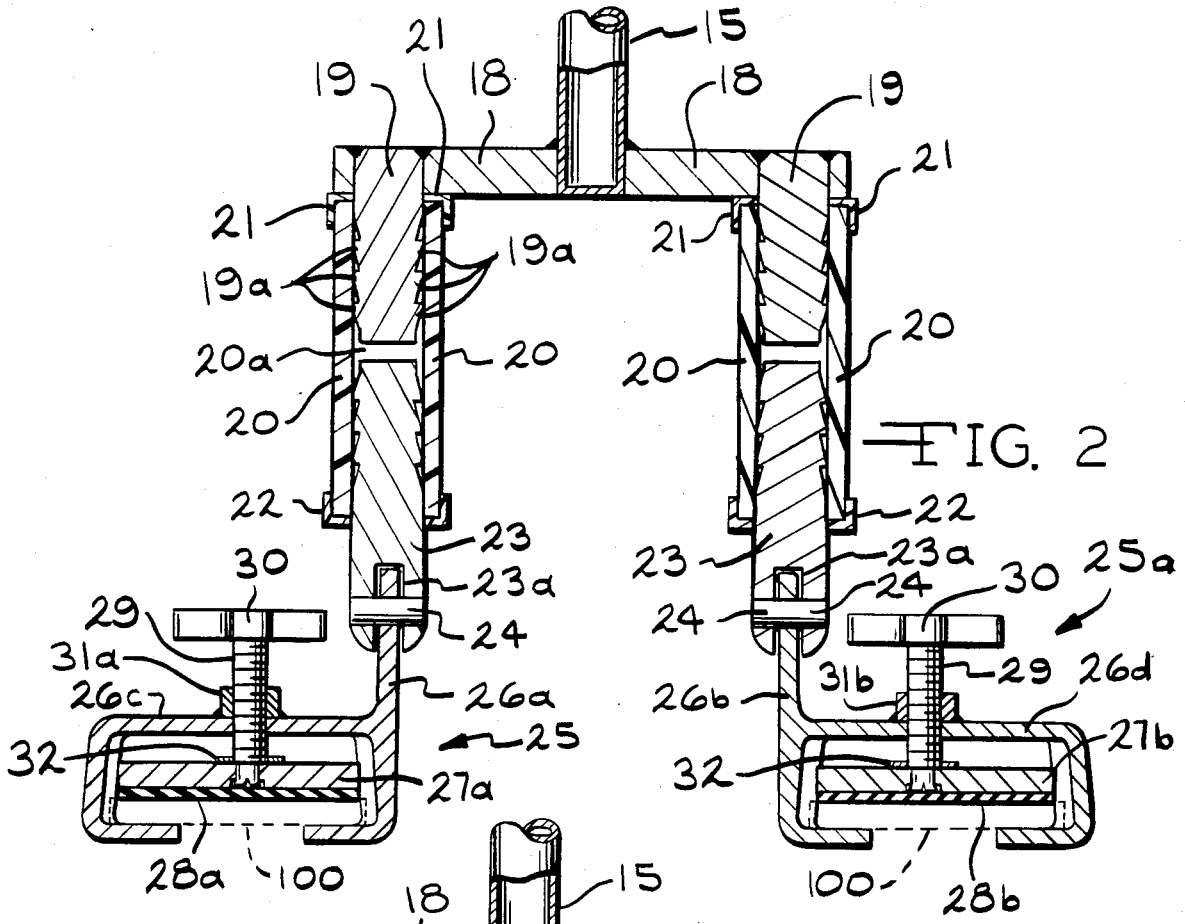
FIG. 2 is a front partial cross-sectional view along line 2—2 of FIG. 1 showing the construction of the steering fork, tines, flexible connectors, and ski clamp.

Referring to FIGS. 1 and 2, a preferred embodiment of the ski steering apparatus 10 of the present invention is shown. Identical parts are similarly numbered. The apparatus 10 includes a U-shaped handle bar 11 with handle portions 11*a* supporting grips 12. The grips 12 include circular guards 12*a* which aid the skier and a downhill trainer as discussed hereinafter. Preferably the U of the bar 11 faces away from the skier to facilitate steering by the skier or the trainer. The bar 11 is attached to a column 13. A face plate 14 is secured to the bar 11 and column 13 to insure that twisting of the column 13 about longitudinal axis a—a does not separate the bar 11 from the column 13. The column 13 includes a telescoping member 15 which is elongated or retracted along the length of the column on axis a—a to adjust the height of the column 13 and telescoping member 15 relative to the skis (100). The member 15 is locked into position on the column 13 by means of threaded bolt 16 which is turned by knob 17 into holes 15*a* in member 15. The member 15 is attached to fork 18 which supports a pair of spaced apart tines 19. The tines 19 include ribs 19*a* which aid in holding flexible tubes 20 on the tines 19 by means of an opening 20*a* which is press fit onto the tines 19 at first top portions of the tube 20. The tubes 20 are provided with nylon caps 21 and 22 which prevent the ends of the tubes 20 from tearing. The flexible tubes 20 rotate on tines 19 when the skis are moved into and out of a snow plow skiing position.

At the opposite bottom portions of the tubes 20, rods 23 with ribs 23*a* are inserted into the openings 20*a* in the tubes 20. The rods 23 and tines 19 are in closely spaced relationship to each other. The rods 23 include slots 23*a* parallel with longitudinal axis of the skis 100. Pins 24 are mounted perpendicular to each slot 23*a*. Clamps 25 and 25*a* (which are mirror images of each other) are pivotably mounted on pins 24 by means of extensions 26*a* and 26*b* which fit into slots 23*a*. The extensions 26*a* and 26*b* project upward from plates 26*c* and 26*d* which are adapted to engage the curved tip of the ski 100 across the top and around the sides and part of the bottom of the ski 100 shown by the dotted lines in FIG. 2. The skis 100 are clamped onto the plates 26*c* and 26*d* by means of shoes 27*a* and 27*b* with a facing material 28*a* and 28*b* of rubber or the like. The shoes 27*a* and 27*b* are moved onto the skis by means of bolts 29 through plates 26*c* and 26*d* on threaded inserts 31*a* and 31*b* attached to the plates 26*c* and 26*d*. Knobs 30 are used to move the bolts 29 and shoes 27*a* and 27*b* so that the facing material 28*a* and 28*b* engages the skis 100 to hold the clamps 25 and 25*a* in place on the skis 100. The washers 32 prevent the bolts 29 from gouging the shoes 27*a* and 27*b* which are preferably made of aluminum.

Figure 3:
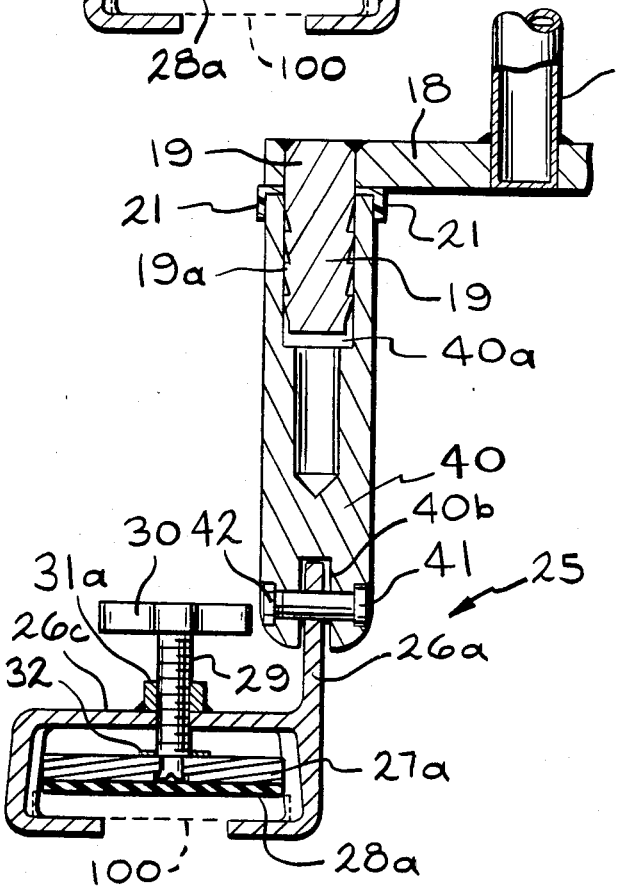
FIG. 3 is a front partial cross-sectional view of an alternative preferred embodiment of a flexible connector attached to one tine of the fork and to the clamp.
Figure 4:
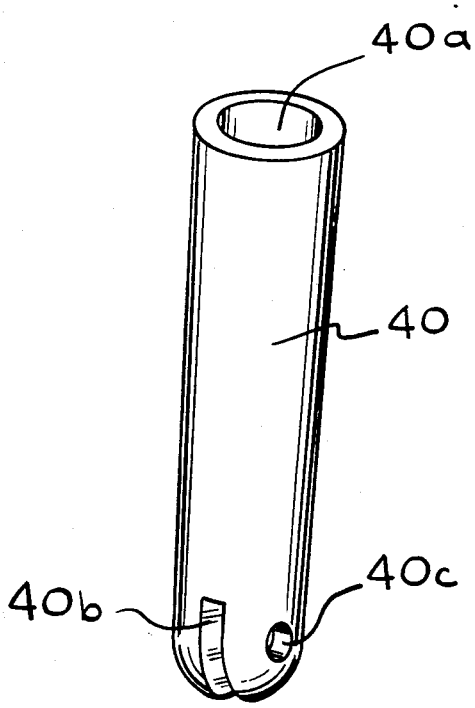
FIG. 4 is a front perspective view of the flexible connector shown in FIG. 3.

FIGS. 3 and 4 show a variation of the apparatus shown in FIGS. 1 and 2. The identical parts to those in FIGS. 1 and 2 are similarly numbered. A flexible cylinder 50 of a solid polyurethane or the like with an opening 40*a* is provided which securely engages the tines 19 (one shown). The extension 26*a* of the clamp 25 is pivotably secured in a slot 40*b* in the cylinder 40 by means of a bolt 41 and nut 42 in opening 40*c*.

In operation of the ski steering apparatus 10, the handle bar 11 is twisted by the skier along its axis a-a by means of grips 12 in the opposite direction of the turn. The twisting motion in the direction opposite to the direction of the turn causes flexible members tube 20 or cylinder 40 or other rotatable and pivotable joint connector to twist and move the ski on the inside edge of the downhill ski to turn the skis while also lifting the outside edge of the uphill ski. The skier merely leans away from the direction of the turn. When a trainer is downhill of the skier, the trainer holds the grips 12 with his hands engaging the circular guard 12*a* and turns the bar 11 away from the direction of the turn to edge the downhill ski. When the trainer is wearing skis and skiing backwards, an easy movement of the skier down the slope of a hill is achieved.

It is intended that the foregoing description of the present invention be only illustrative and that the invention be limited only by the hereinafter appended claims.

I claim:

1. A ski steering apparatus for a pair of downhill snow skis with curved tips at a downhill end, each ski having a top, opposed side edges and a bottom which comprises:

(a) a handle bar with handles at opposite ends of the bar for each hand of a skier;

(b) support means defining a longitudinal axis of the apparatus mounted on the handlebar between the grips;

(c) a fork mounted on the support means;

(d) a pair of spaced apart pivotable and rotatable joint connector means joined to the fork; and (e) clamp means for attachment to each ski adjacent the tips of the skis joined to the joint connector means, wherein the skis are steered into a turn by a skier by rotating the apparatus on the longitudinal axis of the support means with the handlebar in a direction opposite to the direction of the turn.

2. The apparatus of claim 1 wherein the handles support grips having a circular guard adjacent the handlebar.

3. A ski steering apparatus for a pair of downhill snow skis with curved tips at a downhill end, each ski having top, opposed side edges and a bottom which comprises:

(a) a handle bar with handles at opposite ends of the bar for each hand of a skier;

(b) support means defining a longitudinal axis of the apparatus mounted on the handle bar between the grips;

(c) a fork mounted on the support means having a pair of spaced apart tines;

(d) flexible connector means each having a top portion and a bottom portion joined to each of the tines at the top portions; and (e) clamp means for attachment to each ski adjacent the tips of the skis joined to the bottom portion of the flexible connector means wherein the skis are steered into a turn by the skier by rotating the apparatus on the longitudinal axis of the support means with the handlebar iin a direction opposite to the direction of the turn.

4. The apparatus of claim 3 wherein the flexible connector means are flexible tubes with the top portion and the bottom portion having openings in the top portions, wherein the openings are inserted over the tines at the top portion of each tube.

5. The apparatus of claim 4 wherein rods are mounted on the clamp means which extend into openings in the bottom portions of the flexible tubes.

6. The apparatus of claim 4 wherein the tines are ribbed to rotatably hold the flexible tubes in place on the tines and wherein rods are mounted on the clamp means which extend into openings in the bottom portions of the flexible tubes and wherein the ribs are provided on the rod to rotatably hold the rod in place on the flexible tubes.

7. The apparatus of claim 6 wherein the rods and the tines are in closely spaced opposed relationship to each other in the openings of the flexible tubes.

8. The apparatus of claim 3 wherein the support means includes an adjustment means which can be adjusted along the longitudinal axis to change the height of the handle bar from the clamp means.

9. The apparatus of claim 3 wherein each of the clamp means includes a shoe movable by a bolt mounted on a plate to engage a ski and wherein the plate encircles the ski across the top, around the edges and at least part of the bottom of the ski.

10. The apparatus of claim 3 wherein the flexible connector means are flexible cylinders with openings at the top portions which are inserted over the tines and with slots at the bottom portions which pivotably engage the clamp means for movement of the handlebar, support means, fork and flexible cylinder towards and away from the tips of the skis.

11. The apparatus of claim 3 wherein the flexible connector means is pivotably connected to the clamp means for movement towards and away from the tips of the skis.

12. The apparatus of claim 3 wherein the handles are provided with grips having a circular guard adjacent the handlebar.

13. The method of training a snow skier which comprises:

(a) providing a ski steering apparatus for a pair of downhill snow skis with curved tips at a downhill end, each ski having top, opposed side edges and a bottom the apparatus having a handle bar with handles at opposite ends of the bar for reach hand of a skier, support means defining a longitudinal axis of the apparatus mounted on the handle bar between the grips, a fork mounted on the support means, a pair of spaced apart pivotable and rotatable joint connector means joined to the fork, and clamp means for attachment to each ski adjacent the tips of the skis joined to the joint connection means;

(b) providing the handle bar and grips in a position with the grips in front of the tips of the skis in position for a trainer facing the skier to grip the handles to steer the skier downhill and;

(c) steering the skis downhill, wherein the skis on the skier are steered into a turn by rotating the apparatus on the longitudinal axis of the support means with the handlebar in a direction opposite to the direction of the turn.

14. The method of training a snow skier which comprises:

(a) providing a ski steering apparatus for a pair of downhill snow skis with curved tips at a downhill end, each ski having top, opposed side edges and bottom flexible connection to each ski which comprises a handle bar with handles at opposite ends of the bar for each hand of a skier, support means defining a longitudinal axis of the apparatus mounted on the handle bar between the grips, a fork mounted on the support means; a pair of spaced apart pivotable and rotatable joint connector means joined to the for; and clamp means for attachment to each ski adjacent the tips of the skis joined to the joint connector means; and (b) steering the skis into a turn by rotating the handlebars on the longitudinal axis of the support means with the handlebar in a direction opposite to the direction of the turn.

* * * * *